US006221236B1

(12) United States Patent
Hirokawa et al.

(10) Patent No.: US 6,221,236 B1
(45) Date of Patent: Apr. 24, 2001

(54) APPARATUS AND METHOD FOR ELECTROLYTIC TREATMENT

(75) Inventors: Tsuyoshi Hirokawa; Toru Yamazaki; Atsushi Matsuura, all of Shizuoka (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/344,107

(22) Filed: Jun. 24, 1999

(30) Foreign Application Priority Data

Jun. 26, 1998 (JP) ..... 10-180149

(51) Int. Cl.[7] ..... C25F 3/02

(52) U.S. Cl. ..... 205/659; 205/658; 204/211; 204/230.6; 204/242; 204/DIG. 9

(58) Field of Search ..... 204/211, 242, 204/230.6, DIG. 9; 205/658, 659

(56) References Cited

U.S. PATENT DOCUMENTS 4,315,806 2/1982 Arora .
4,482,434 * 11/1984 Pliefke ..... 204/33
5,082,537 * 1/1992 Stroszynski et al. ..... 205/139
5,755,949 * 5/1998 Amor ..... 205/153

FOREIGN PATENT DOCUMENTS 0 390 033 10/1990 (EP) .
0 585 586 3/1994 (EP) .

* cited by examiner

*Primary Examiner*—Kathryn Gorgos
*Assistant Examiner*—Christopher M. Keehan
(74) *Attorney, Agent, or Firm*—Burns, Doane, Swecker & Mathis, LLP

(57) ABSTRACT

This invention provides an apparatus for electrolytic treatment capable of removing the ununiformity according to the frequency and can achieve high treating speed and high current density treatment, which comprises etching a metal web electrolytically using alternating waveform current continuously, wherein a frequency-variable means having an ability to vary frequency of an electric power supply of said alternating waveform current arbitrarily is provided, and a method therefor.

6 Claims, 1 Drawing Sheet

APPARATUS AND METHOD FOR ELECTROLYTIC TREATMENT

BACKGROUND OF THE INVENTION

This invention relates to an apparatus and method for electrolytic treatment which comprises etching a metal web electrolytically using alternating waveform current continuously, and particularly, relates to an apparatus and method for electrolytic treatment suitable for electrolytic etching of aluminum web during manufacturing a support for planographic printing plate.

Electrolytic etching of a surface of aluminum, iron or the like is widely utilized, and alternating waveform current is generally used due to required quality and the improvement in reaction efficiency. For example, Japanese Patent KOKOKU 56-19280 discloses an electrolytic etching treatment which can provide excellent roughening as a support for an offset printing plate by using an alternating waveform current impressed to that the electric voltage at anode is made greater than the electric voltage at cathode in electrolytic roughening of an aluminum plate.

In general, electrolytic etching is carried out at a current density of 10 to 100 $A/dm^2$ in an acidic electrolytic solution, such as 1 to 5% nitric acid or hydrochloric acid. Upon treating electrolytically an aluminum plate as the metal web, $Al \rightarrow Al^{3+}+3e$ dissolution reaction occurs at an anode period, and $H^+|e$; $(½)H_2\uparrow$ hydrogen gas generation reaction and $Al^{3+}+3OH \rightarrow Al(OH)_3$ aluminum hydroxide smut formation reaction occur simultaneously at a cathode period on the aluminum plate.

These reactions occur alternately according to the frequency of power supply, and, in general, it is possible to obtain a required roughened surface by adjusting these fundamental reactions by controlling electrolytic conditions, such as the type and concentration of electrolytic solution, temperature conditions, current density and charged quantity of electricity.

Hereupon, in the case of using alternating waveform current, there are necessarily differences between the treatment initiating part by the dissolution reaction and the terminating part caused by the current cycle on entering a metal web into an electrolytic bath and on going out of the bath. These differences generate according to the frequency of a power supply. For example, in the case of a treating speed of 50 m/min and a frequency of power supply of 60 Hz, the differences generate at an interval (pitch) of 1.39 cm in the longitudinal direction of the metal web. In view of massproduction, a higher treating speed and a higher current density treating speed and a higher current density treatment are desired. In the case of high strength aluminum support containing manganese or the like which recently increases, there is a tendency to manufacture a high quality support for planographic printing plate by lowering frequency.

On the other hand, the degree of the above mentioned ununiformity according to the frequency of power supply becomes stronger by higher treating speed, higher current density or lower frequency due to its generation mechanism.

In this regard, Japanese Patent KOKAI 1-230800 discloses an electrolytic apparatus provided with low current density zones at the entrance and exit, i.e. the front end and rear end of an electrode, and Japanese Paten KOKAI 4-289200 discloses a roughening method using a power supply frequency of 1 to 30 Hz.

However, according to the conventional methods mentioned above, the ununiformity according to the frequency cannot be removed entirely in the case of high treating speed, high current density or variation of electrolytic solution conditions.

SUMMARY OF THE INVENTION

An object of the invention is to provide an electrolytic treatment apparatus and an electrolytic treatment method which remove the ununiformity according to the frequency and can achieve high treating speed and high current density treatment.

The inventors investigated eagerly as to the nonuniformity of metal web according to the frequency, and as a result, they found that there is a special frequency capable of reducing the ununiformity under prescribed conditions, such as treating speed and current density.

That is, as mentioned previously, electrolytic conditions, i.e. the type, concentration and temperature of the electrolytic solution used, current density, charged quantity of electricity, electrolytic treatment period, frequency and the like are set so as to obtain a required roughened surface. Heretofore, the frequency was set usually by a unit of 10 Hz, such as 40 Hz, 50 Hz or 60 Hz. The inventors found that there is an optimum frequency which is slipped from the above magnification of 10 Hz or the like.

Thus, the present invention provides an apparatus for electrolytic treatment which comprises etching a metal web electrolytically using alternating waveform current continuously, wherein a frequency-variable means having an ability to vary frequency of an electric power supply of said alternating waveform current arbitrarily is provided, and a method for electrolytic treatment which comprise etching a metal web electrolytically using alternating waveform current continuously, wherein frequency of said alternating waveform current is other than a magnification of 10 Hz but produces optimum ununiformity.

Figure 1:
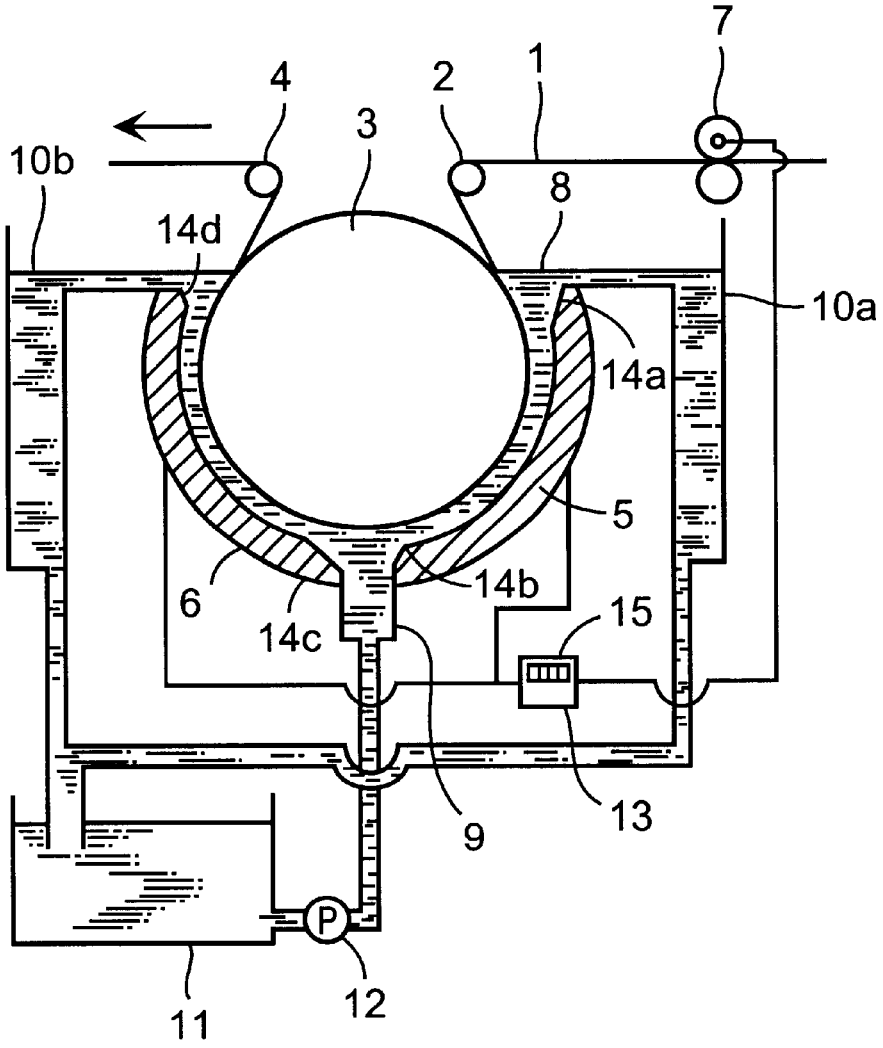
FIG. 1 is a schematic section of an apparatus for electrolytic treatment which embodies the invention.

1 . . . Metal web
2 . . . Pass roller
3 . . . Drum Roller
4 . . . Pass Roller
5, 6 . . . Electrode
7 . . . Electric supplier roller
8 . . . Electrolytic solution
9 . . . Supply port
10*a*, 10*b* . . . Discharge portion
11 . . . Circulation tank
12 . . . Pump
13 . . . Power supply
24 . . . Cut off portion
15 . . . Frequency controller

DETAILED DESCRIPTION OF THE INVENTION

As mentioned previously, the power supply frequency was set by varying the uppermost order numeral, such as 60 Hz. In the method of the invention, an optimum frequency is sought as to a subordinate order, particularly at an interval of less than 1 Hz, preferably 0.5 Hz or less, more preferably 0.2 Hz of less, preferably 0.1 Hz or less, further more, particularly preferably 0.01 Hz or less. The searching range is enough usually in the range of ±5 Hz, preferably ±2.5 Hz, particularly preferably ±0.5 Hz.

The frequency-variable means may be any means capable of varying the frequency of the alternating waveform power supply, and for example, a frequency controller having a crystal oscillator which varies a ratio of frequency division can be used. A preferable frequency-variable means has an ability to vary frequency at an interval of less than 1 Hz, such as at an interval of 0.01 Hz or to vary frequency continuously. The frequency-variable means may be arranged so as to vary frequency automatically or manually according to the type, concentration or temperature of the electrolytic solution, current density, charged quantity of electricity or electrolytic treatment period.

The optimum, frequency can be evaluated by the ununiformity of the electrolytically treated surface of the metal web. Hereupon, roughening is surface roughening formed by the electrochemical treatment, and the ununiformity is ununiform roughening. The optimum frequency is evaluated by the formation of uniform roughening.

The apparatus and method of the invention is effective in high treating speed and high current density treatment. The high treating speed is 40 m/min or more, preferably 50 m/min or more, particularly preferably 60 m/min or more. The high current density treatment is 5 A/dm$^2$ or more, preferably 10 A/dm$^2$ or more, particularly preferably 20 a/dm$^2$ or more.

By applying the invention, since an optimum frequency can be set according to electrolytic conditions upon conducting electrolytic etching of a metal web continuously by using alternating waveform current, uneven treatment can be reduced. As a result, a high electrolytic treatment speed and a high current density treatment are possible, and a high quality support for planographic printing plate can be manufactured cheaply.

EXAMPLE

An apparatus for electrolytic treatment is illustrated in FIG. 1 which comprises a drum roller 3 and electrodes 5, 6 concentrically provided with the drum roller 3 on the outside thereof. That is, the distance between the drum roller 3 and each electrode 5, 6 is kept constant except both ends, and set at a distance selected in the range of 5 to 50 mm. Both ends 14*a*, 14*b*, 14*c*, 14*d* (cut off portion) of each electrode 5, 6 is cut off obliquely so as to leave the surface of the drum roller 3 gradually to form a low current density zone. A metal web 1 enters horizontally from the right side in the figure, and after passing nip rollers containing an electric supplier roller 7, turns downward by a pass roller 2. The electric supplier roller 7 is driven at the same speed as the traveling speed of the metal web 1. The metal web 1 is wound around the drum roller 3, while electric treatment is carried out. Then, the metal web 1 leaves the drum roller 3, turns to horizontal direction by a pass roller 4, and further travels.

An electrode solution 8 is put in a circulation tank 11, and supplied from a supply port 9 located at the bottom of the electrolytic cell to fill the space between the drum roller 3 and the electrodes 5, 6 by a pump 12. The electrolytic solution 8 overflows from the upper edge of each electrode 5, 6, and returns to the circulation tank 11 through the discharge portion 10*a*, 10*b*.

Alternating waveform current is supplied from an alternating waveform current power supply 13. One output terminal of the power supplier 13 is connected to the electric supplier roller 7, and the other output terminal is connected to the electrodes 5, 6. The power supply 13 is provided with a frequency controller 15 as the frequency-variable means, and the frequency of the output alternating waveform current can be set arbitrarily at an interval of 0.01 Hz.

Using the above electrolytic treatment apparatus, electrolytic etching of an aluminum web was carried out.

The electrolytic conditions are as follows:

| | |
|---|---|
| Aluminum web width: | 1000 mm |
| Treating speed: | 50 m/min |
| Type of electrolytic solution: | 1% of nitric acid |
| Temperature: | 40 ° C. |
| Current density: | 50 A/dm$^2$ |
| Frequency: | 60.00–60.50 Hz |

The result are shown in Table 1.

TABLE 1

| Frequency (Hz) | Ununiformity |
|---|---|
| 60.1 | ○Δ |
| 60.2 | ○Δ |
| 60.3 | ○ |
| 60.4 | ○Δ |
| 60.5 | ○Δ |

○: Almost none
○Δ: Slightly

The evaluation of ununiformity was carried out by visual observation.

What is claimed is:

1. A method for electrolytic treatment, comprising etching a metal web electrolytically using alternating waveform current continuously, wherein the frequency of said alternating waveform current is other than a magnification of 10 Hz but produces optimum ununiformity, said frequency having a decimal in one tenth order, and said frequency being set by searching for an optimum frequency at an interval of less than 1 Hz.

2. The method of claim 1, wherein said frequency is in the range of the magnification of 10 Hz±2.5 Hz.

3. The method of claim 1, wherein said frequency is in the range of the magnification of 10 Hz±0.5 Hz.

4. The method of claim 1, wherein said frequency is in the range of 60 Hz±2.5 Hz.

5. The method of claim 1, wherein said frequency is in the range of 60 Hz±0.5 Hz.

6. The method of claim 1, wherein the searching of the frequency is carried out without varying other factors.

* * * * *